United States Patent [19]

Padilla

[11] Patent Number: 4,599,805

[45] Date of Patent: Jul. 15, 1986

[54] TRANSMUTABLE RULE

[76] Inventor: Amando C. Padilla, 187 Apartado Postal, Hermosillo, Sonora, Mexico

[21] Appl. No.: 673,717

[22] Filed: Nov. 21, 1984

[51] Int. Cl.[4] ..... B43C 7/06

[52] U.S. Cl. ..... 33/464; 33/474; 33/479; 33/484

[58] Field of Search ..... 33/464, 470, 472, 474, 33/479, 452, 462, 483, 484

[56] References Cited

U.S. PATENT DOCUMENTS 888,070 5/1908 Dissell ..... 33/464

1,039,057 9/1912 Hill ..... 33/464

2,908,079 10/1959 Barrett ..... 33/484

*Primary Examiner*—Willis Little

*Attorney, Agent, or Firm*—Paul H. Gallagher

[57] ABSTRACT

A pair of simple rules, each having a body portion identical with a standard rule and a head at one end cooperating with the other rule, for placing the two rules in an arrangement forming a T-square, and enabling one to be moved or slid along the other. A modified form includes means for releasably binding the two rules together in set position.

4 Claims, 6 Drawing Figures

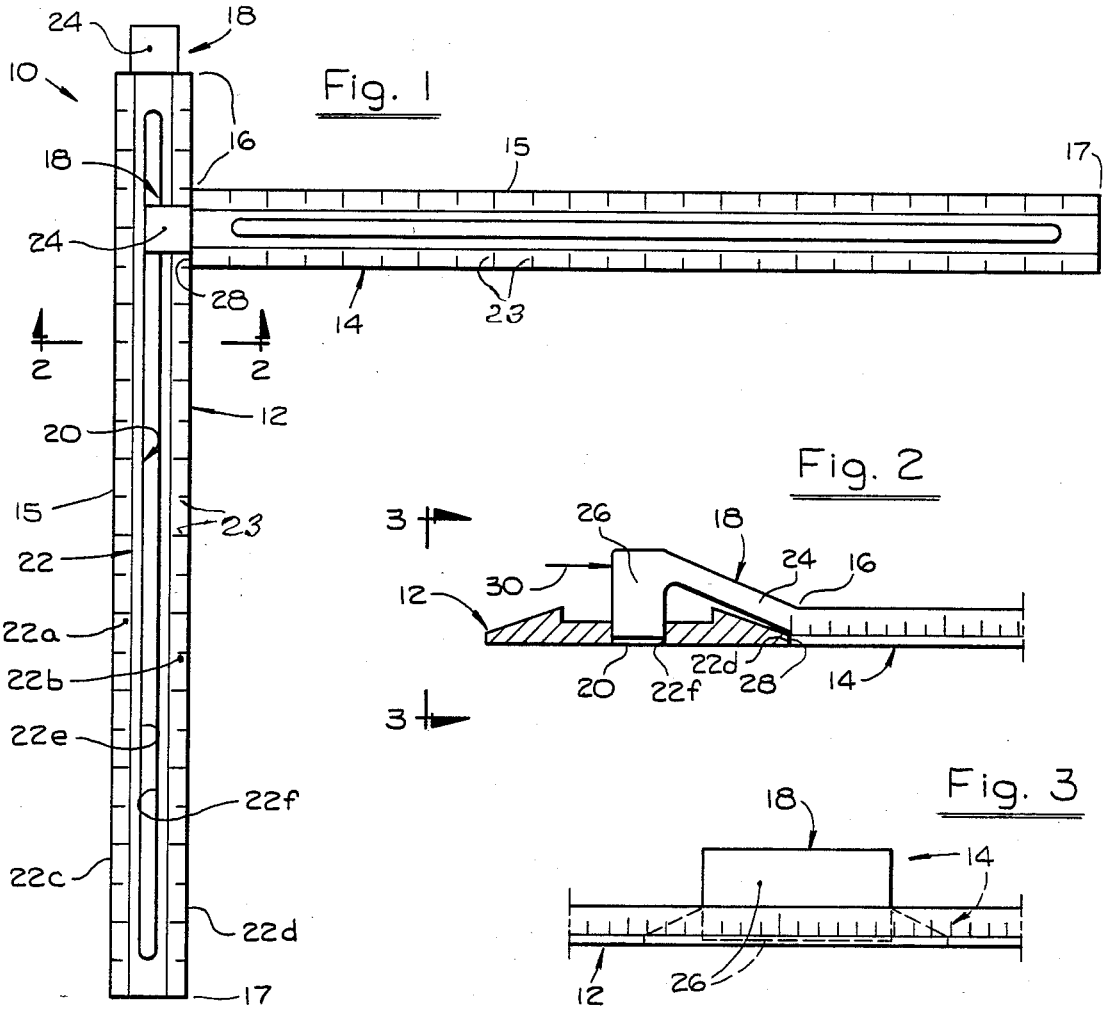
Fig. 1
10
12
14
15
16
17
18
20
22
22a
22b
22c
22d
22e
22f
23
24
28
2
2
Fig. 2
3
3
12
14
16
18
20
22d
22f
24
26
28
30
Fig. 3
12
14
18
26
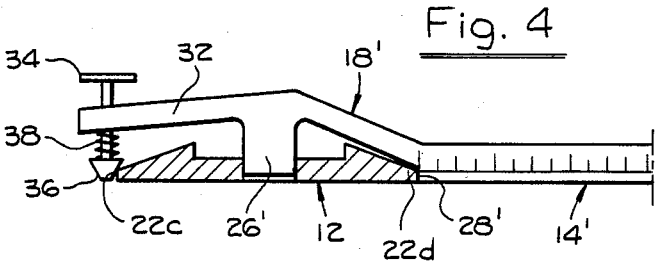
Fig. 4
12
14'
18'
22c
22d
26'
28'
32
34
36
38
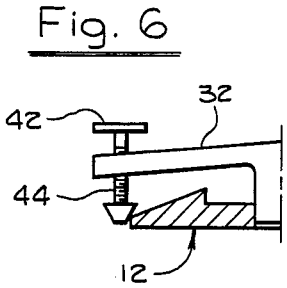
Fig. 6
12
32
42
44
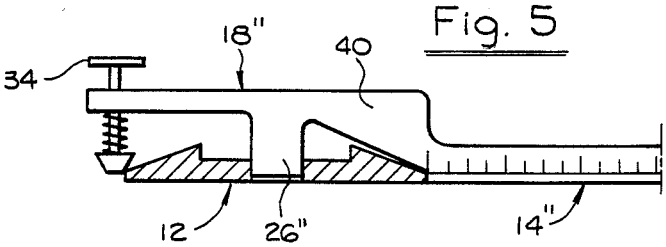
Fig. 5
12
14"
18"
26"
34
40

TRANSMUTABLE RULE

FIELD OF THE INVENTION

The invention resides in the field of drafting. In the case of a person who has not progressed far in the drafting field, such as a beginner, or a student, his instruments are very simple, and often do not include a T-square. However, there is sometimes occasion to use such an instrument, but a standard T-square is usually large and cumbersome, and is ordinarily not provided in drafting sets furnished for nonprofessional draftsmen.

OBJECTS OF THE INVENTION

A broad object of the invention is to provide a novel drafting instrument made up of components expediently combined, each of which includes, as a main part, a simple standard rule with a simple modification.

Another object is to provide a drafting instrument of the foregoing character which utilizes a pair of rules, each of which can be used separately, and independently of the other, and the two capable of being put together to form a T-square.

An additional object is to provide a drafting instrument of the character just referred to, wherein the individual rules can be easily placed side-by-side when not in use, thereby eliminating the relatively great transverse dimension found in the usual T-square.

DESCRIPTION OF A PREFERRED EMBODIMENT

In the drawings,

FIG. 1 is a plan view of the transmutable rule of the invention;

FIG. 2 is a large scale sectional view taken at line 2—2 of FIG. 1;

FIG. 3 is an elevational end view taken at line 3—3 of FIG. 2;

FIG. 4 is a fragmentary view oriented according to FIG. 2, showing a modified form;

FIG. 5 is a view similar to FIG. 4 showing another modified form; and

FIG. 6 is a view similar to FIGS. 4 and 5 showing still another modified form.

Referring in detail to the accompanying drawings, it is pointed out that the transmutable rule of the present invention is a combination of two separate individual rules, each of which is identical with a standard and well known type, but with the addition of a guide means at the end which cooperates with the other rule.

Referring to FIGS. 1 and 2, the transmutable rule is indicated in its entirety at 10, which is a set of two identical rules,—a first rule 12 and a second rule 14. Each rule as indicated above is a standard and well known rule, each including a body portion 15 beginning at a point 16 and continuing to the opposite end indicated at 17. Each rule includes a guide means or head 18 forming an extension of the body portion, which cooperates with the other rule.

Each rule includes a longitudinal slot 20 therethrough extending to adjacent the ends of the rule, and thus forming a pair of structural elements or longitudinal bars 22 individually identified 22*a* and 22*b*. These bars or elements define side edges, individually identified for convenience as outer edges 22*c*, 22*d*, and inner edges 22*e*, 22*f*. At least certain of these edges will be referred again hereinbelow in the description of the use of the device. Each rule includes measuring scales 23.

FIG. 1 shows the rule 14 with its guide means applied to the rule 12, but they may be combined in the opposite position, as referred to again hereinbelow. The guide means 18 includes an inclined element 24 (FIG. 2) leading from the body of the rule 14, and a downwardly extending terminal guide element or finger 26 which extends into the slot 20 of the rule 12, when the individual rules are assembled. Preferably the inclined element 24 and the guide element 26 are integral with each other and with the body of the rule 14. The individual rules can be made of any suitable material.

Preferably the inclined element 24 leads from the upper portion of the body of the rule 14, forming a vertical front end eddge 28 which facilitates fitting the individual rules together, and enables the rule 14 to lie flat on the surface throughout its length, when it is assembled with the first rule 12. Preferably the guide element or finger 26 is of such vertical dimension that when the rules are fitted together, it does not engage the surface on which the rules lie, but terminates slightly short thereof, as indicated in FIGS. 2 and 3.

In the use of the transmutable rule, or combination rule, when the individual rules are fitted together as stated, the rule 14 extends precisely perpendicular to the rule 12, forming a T-square. Additionally, the rule 14 can be slid along the rule 12, longitudinally of the latter. The rule 14 can be used as a straight edge, or to mark off dimensions as indicated by the scale thereon, and because the rule 14 can be slid along to different positions, the combination rule will serve many of the functions of a T-square in which the latter is fitted to the edge of a board and can be moved. In addition to the rule 14 being used as a straight edge or a dimension indicator, the same is true of the first rule 12.

The perpendicular positioning of the rules is easily accomplished. For example, the guide finger 26 is of substantial width (FIGS. 1, 3), and it engages the edge 22*f* throughout that width and so maintains the accurate positioning. In the use of the combination rule, the user can easily apply pressure by a finger at the point indicated by the arrow 30 (FIG. 2) to bias the second rule 14 outwardly, i.e., to a position in which the finger 26 engages the edge 22*f*.

If desired, the distance between the finger 26 and the edge 28 can be accurately dimensioned whereby the finger will engage the bar 22*b* of the first rule with a clamping pressure, to normally hold the two rules in the desired position, without slipping, but readily yielding to the hand pressure of the user for shifting the second rule 14 along the first rule 12.

The illustration shows the guide means 18 as narrower than the body portion of the rule 14 (FIGS. 1, 3) but this dimensioning is a matter of convenience, and it may assume the full width of the body portion of the rule, if that is desired. The edge 28 of the rule 14 extends throughout the full width of the body portion of the rule, and the engagement of this edge, throughout its entire length, with the first rule 12, gives greater assurance of accurate positioning the individual rules in mutual perpendicular relation.

Since the rules are identical in construction, they may be applied in opposite position, as indicated above, that is, the guide means of the rule 12 applied to the rule 14. Because of this, they may be assembled very quickly and easily, but another, and great, advantage results, namely, each rule can be provided with different scales, resulting in four different scales in two rules, and of course more than two rules can be included in a set.

Another advantage is that either rule, 12 or 14, can be used in combination with an ordinary rule without a guide means.

Additionally, either rule, 12 or 14, can be used as an ordinary rule, and the guide means 18 thereon being very small, and not materially interfering with the handling of the rule. The two individual rules, when disassembled can easily be fitted together in side by side position, and the two together occupy a volume that is only insignificantly greater than that of a single rule.

FIGS. 4–6 show an optional feature, which may be incorporated in the device, if desired. This feature provides a locking effect between the individual rules.

In FIG. 4 the second rule 14' includes the front end edge 28' and the guide means 18' includes a forward extension 32 in which a locking pin 34 is slidably fitted, extending downwardly, and having a button 36 engaging the front edge **22*c* of the first rule 12. The pin 34 is biased downwardly by a compression spring 38. The button 36 is tapered, and upon being forced downwardly, wedges the first rule 12 against the second rule 14 (to the right, FIG. 4) where the edge 22*d* engages the edge 28'. The two rules are thus held in mutual locked position by friction. Although this locking effect is of minor force, it is of sufficient effectiveness in ordinary use where the rules lie on a common surface and only deliberately moved by the user. The construction of FIG. 5 includes an enlargement 40 on the guide means 18"** which provides greater massiveness and strength to the guide means.

FIG. 6 shows a pin 42 which is similar to the pin 34, but is of screw threaded form as indicated at 44, instead of utilizing the compression spring 38.

End of Descriptive Specification

I claim:

1. A transmutable rule comprising, a pair of individual rules, each individual rule having scales along its side edges and each having a longitudinal slot therein extending nearly, but not entirely, its full length, and each individual rule including guide means at one end engageable in the slot of the other individual rule in interfitting relation in which the individual rules are mutually perpendicular, and relatively slideable, and remain in said perpendicular relation throughout their sliding movement, each guide means being resiliently attached to a respective one of said rules, each rule having mutually opposed gripping elements, one of which is on the guide means thereof, so positioned that when the guide means of one rule is in the slot of the other, said opposed gripping elements frictionally engage a structural element of the other rule; and the guide means, through the resiliency thereof, effects yieldable frictional gripping by said opposed gripping elements on the other rule, in the absence of positive locking.

2. A transmutable rule according to claim 1 wherein, the individual rules include a first rule and a second rule, the first rule constitutes a stationary member and the second rule has its guide means fitted in the slot in the first rule and is slidable along the first rule, the individual rules are so shaped that when they are in said interfitting relation, their bottom surfaces lie in a common plane whereby to enable them to lie on a common planar supporting surface.

3. A transmutable rule according to claim 2 wherein, each guide means is in an upper position, leaving an end edge surface of the main portion of the rule, whereby in the case of each individual rule, when it constitutes the second rule, said end edge surface thereof engages the edge of the first rule, assisting in maintaining said perpendicular relation between the individual rules.

4. A transmutable rule according to claim 3 wherein, the guide means includes a finger, and such finger in the second rule is positioned in the slot of the first rule, and the guide means is so proportioned and positioned relative to the main portion of the rule, that the finger and end edge surface act to grip the first rule therebetween, and assist in retaining the individual rules in interfitted relation.

* * * * *